US005531448A

United States Patent [19]

Moody

[11] Patent Number: 5,531,448

[45] Date of Patent: Jul. 2, 1996

[54] POKER-STYLE CARD GAME

[76] Inventor: Ernest W. Moody, 4381 Pebble Beach Dr., Niwot, Colo. 80503

[21] Appl. No.: 495,952

[22] Filed: Jun. 28, 1995

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS 5,382,025 1/1995 Sklansky et al. ..... 273/292

OTHER PUBLICATIONS

Scarne's Encyclopedia of Card Games, 1983, ISBN 0–06–091052–6 (pbk), pp. 22–23 "Twin Beds".

Scarne's Enclclopedia of Card Games, 1983, ISBN 06–06–091052–6 (pbk), p. 23.

Scarne's Encyclopedia of Card Games, 1983, ISBN 0–091052–6 (pbk), p. 22.

Scarne's Encyclopedia of Card Games, 1983, ISBN 0–06–091052–6 (pbk), pp. 23–28 "Lame Brain, Criss Cross", Bing–O–Draw.

Scarne's Encyclopedia of Card Games, 1983, ISBN 0–06–091052–6 (pbk), pp. 43–45.

*Primary Examiner*—Benjamin H. Layno

*Attorney, Agent, or Firm*—John E. Roethel

[57] ABSTRACT

In one version of the present invention, the dealer deals three cards to each player. The dealer then deals eight cards as the community cards which are arranged in groups of two each on the gaming table layout. The card layout is in the format of a directional compass with two cards each at the North position, East position, South position and West position, respectively. At the North position, both cards are face down. At the East and West positions, one card is face down and one card is face up. At the South position, both cards are face up. Each player determines which one of the four two-card groups the player wishes to use to comprise his five card. The player identifies this selection by moving his wager to the corresponding compass location on the player's betting spot on the gaming table layout in front of the player. The dealer turns up the remaining community cards and the dealer determines the best hand each player has made according to poker hand rankings. All winning hands will be paid according to the odds listed in the pay table. When the progressive jackpot bonus payout is used, the dealer examines the eight cards of the community cards to determine if one of the predetermined card arrangements has occurred. Any winning payouts from the progressive bonus jackpot are distributed to the players at the table. Other versions of the invention use different community card arrangements and different numbers of community cards.

33 Claims, 10 Drawing Sheets

POKER-STYLE CARD GAME

This invention relates to a poker-style card game, and more particularly to a poker-style card game in which a player attempts to achieve a high ranking poker hand by discarding from his initial hand and using various pre-designated combinations of community cards.

BACKGROUND OF THE INVENTION

Poker-style card games have been played in gaming casinos for many years. Initially, gaming casinos provided segregated card rooms in which the poker players gathered around a poker table and played whatever game was being dealt at that table. The gaming establishment provided the dealers, handled the exchange of money for gaming chips and took a "rake" (a percentage of each poker pot) as the fee for these services. Alternatively, instead of raking from each pot, the gaming establishment would simply charge a time based fee for providing the poker game.

This type of live poker played in legalized gaming establishments such as those in Nevada is not widely accepted by the average gaming patron. Most are afraid to play due to the reputation that "card sharks" are lurking in the poker room, waiting for the unsuspecting player to come along. The poker-style game of the present invention has been created to fill a need so that the average, novice or even first time poker player can participate in a live poker game without feeling he is being hustled.

Of the live poker games currently being offered in gaming jurisdictions, only two, Texas hold-em poker and seven card stud poker, enjoy any degree of popularity and play. Texas hold-em is by far the most popular poker game because of the large number of players who can play at one time and the fast action and large pots that are generated. The game is fast because only two cards are dealt to each player, with the remaining cards being dealt to a "flop" which forms the community cards from which each player makes up the rest of his hand. Each hand, however, has a single set of community cards which all players use as part of their poker hand. Therefore, the winning hand comes from that player whose two cards best fit with the community cards.

Texas hold-em is a difficult game for the novice player to learn to play because it takes considerable study, practice and a large bankroll to become a competent player. For this reason, many novice players avoid the game or are "run off" by the more experienced players who take full advantage of their lack of skill.

The other popular game, seven card stud, is well known to the average player and is easy to understand and play. The problem with this game for the novice player is that, even at low limits, with five rounds of betting and five raises, it can cost upwards of one hundred and fifty dollars just to play one hand. This is an expensive way for new players to get an education.

As a result of this many novice players avoid playing live poker altogether in the casinos. The current player base consists of a group of regular players who dominate the games and often regard the newcomers as "fish". These regulars, who are commonly called "poker bums" concentrate their play in only the larger casinos that have specialized card rooms and are better financed to feed and support them.

In other jurisdictions this problem has been addressed by providing a variety of poker-style table games that are house banked and that are easily played and understood such as Caribbean Stud® Poker and Let It Ride®. A house banked game is a game in which the gaming establishment pays all winning hands and collects all losing hands. These games often feature progressive jackpots and have proved to be very popular with players of all types. These games however are structured as house banked games and as such are not permitted under the gaming regulations of many jurisdictions such as California and Colorado.

In those jurisdictions where house banked poker-style games are not permitted, poker-style games may only be dealt if one of the players at the gaming table is banking the game. That player takes the role of the house and pays all winning hands and collects all losing hands.

The current forms of poker currently being played for the reasons herein discussed have not been widely accepted by the average gaming patron. The poker-style card game of the present invention has been created in both its house banked version and its player banked version to fill a perceived need for the average, novice or first time player.

Additionally, with the advent of computer electronics, one player poker games played on electronic gaming machines have also become quite popular. Five card draw poker was the first poker game adapted to this format and the player attempts to achieve a high ranking poker hand from his initial five card dealt hand and any draw replacement cards he desires. A payout table is provided that pays the player various multiples of his wager depending on the rank of poker hand that the player achieves.

Since the introduction of electronic video draw poker, many other variations of poker have been adapted to electronic one player gaming machines. Joker's wild poker, deuces wild poker and five and seven card stud have all been programmed for play in this style—each with its own unique payout table reflecting the relative odds of achieving various poker hand rankings in each of these games.

The poker-style card game of the present invention is an attempt to provide a game which can be enjoyed by all classes of players including novices and less experienced players. It is designed to be played either as a stand alone pit game (such as Twenty-One or Blackjack) or in a segregated card room. The present invention is an attempt to incorporate the better features of both live table poker and electronic video poker into a single game.

The poker-style card game of the present invention can be played as a house banked game which means that the players do not compete against each other, but rather against the gaming establishment (as the players do in Twenty-One). In a house banked game, all player wins are paid by the gaming establishment and all player losses are collected by the gaming establishment.

Alternatively, the poker-style card game of the present invention can be played as a player banked game. In this version, one of the players at the table bankrolls the game and collects all losing wagers and pays all winning wagers.

The poker-style card game of the present invention can also be played as a "pot" game in the same manner as other poker games have been traditionally dealt in gaming casinos. In a "pot" game, a plurality of players sit at a common table with a dealer provided by the casino. The wagers made by each player are placed in a common pot and the player with the winning hand collects the pot.

It is an object of the present invention to provide a poker-style card game that allows each player to discard certain cards in that player's hand and then use pre-designated community cards as replacement cards to be considered part of that player's hand.

It is a further object of the present invention to provide a new poker-style card game that has a simplified betting structure and can be played either as a house banked game, a player banked game or a pot game.

It is a feature of the present invention that a plurality of community cards, arranged on the gaming table layout, are selectively used by the players to comprise a poker hand. Depending on which cards the player chooses, certain of the community cards are then designated as those used by the player to comprise the player's hand.

It is a further feature of the present invention to provide for an optional progressive bonus feature as part of the play of the game.

It is an advantage of the present invention that the poker-style card game uses a simplified betting structure and community cards to speed play and allow more players to compete. Additionally the progressive bonus feature allows for the thrill of higher jackpots and more ways to win.

Other objects, features and advantages of the present invention will become apparent from a consideration of the following detailed description.

SUMMARY OF THE INVENTION

The object of the game is for a player to form a five card poker hand that has the highest poker hand ranking. The ranking used is the conventional poker hand ranking: Royal Flush, Straight Flush, Four-of-a-Kind, Full House, Flush, Straight, Three-of-a-Kind, Two Pair and a Pair of Jacks or better.

In the house banked version of the method of play of the present invention, all players play against the house and not against each other. The game is played with a standard fifty-two card deck and a betting token for each player that is used to designate which cards the player will be using to comprise his hand. The game consists of a dealer and from one to seven players. Each player makes a bet and a portion of each bet may be allocated to a progressive jackpot.

In one version of the present invention, the dealer deals three cards to each player. The dealer then deals eight cards as the community cards which are arranged in groups or pairs of two cards each on the gaming table layout. In the preferred embodiment of the present invention, the card layout is in the format of a directional compass with a pair of cards each at the North position, East position, South position and West position, respectively.

At the North position, both cards are face down. At the East and West positions, one card is face down and one card is face up. At the South position, both cards are face up.

Each player determines which one of the four two-card groups the player wishes to use to comprise his five card hand. The player identifies this selection by moving his betting token to the corresponding compass direction on the player's betting spot on the gaming table layout in front of the player.

The dealer turns up the remaining community cards which are face down. The dealer then determines the best hand according to poker hand rankings each player has made by combining the player's cards with the pair of cards the player has selected from the gaming table layout. All winning hands will be paid by the dealer according to, the odds listed in the pay table.

When the progressive jackpot bonus payout is used, the dealer examines the eight community cards to determine if one of the predetermined card arrangements has occurred. Any winning payouts from the progressive bonus jackpot are distributed to the players at the table.

Other versions of the present invention use different community card arrangements. The method of the present invention may also be played as a player banked game.

DETAILED DESCRIPTION OF THE PREFERRED EMBODIMENTS

The object of the game is for a player to form a five card poker hand that has the highest poker hand ranking. The ranking used is the conventional poker hand ranking: Royal Flush, Straight Flush, Four-of-a-Kind, Full House, Flush, Straight, Three-of-a-Kind, Two Pair and a Pair of Jacks or better.

In the house banked version of the method of play of the present invention, all players play against the house and not against each other. The game is played with a standard fifty-two card deck and a betting token used by each player. The cards can be shuffled and dealt by hand by a dealer, but in the preferred embodiment, an automatic shuffler is used.

Figure 1:
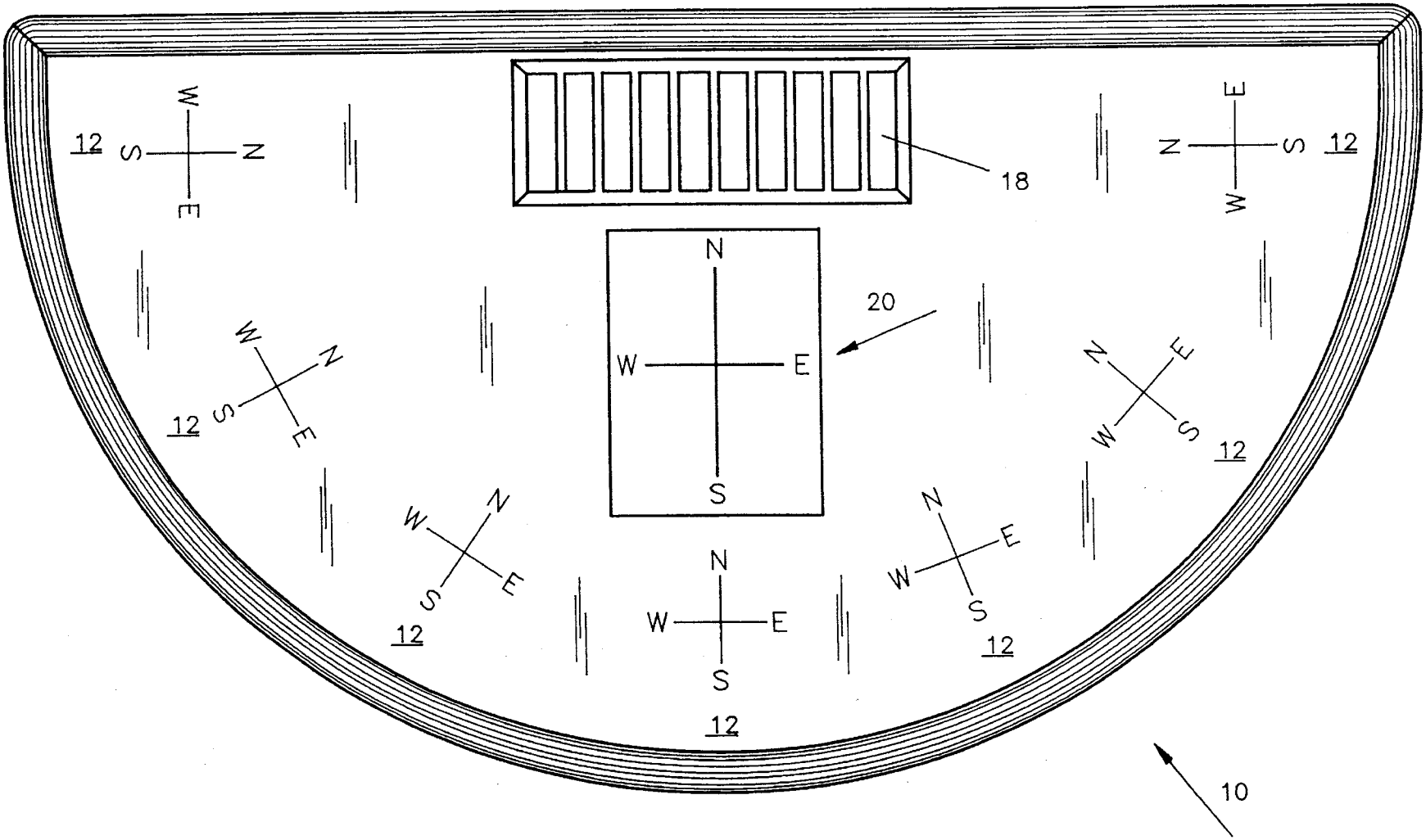
FIG. 1 shows a gaming table layout upon which the house banked version of the present invention may be played.

The game consists of a dealer and from one to seven players. The method of the present invention is practiced using the gaming table layout as shown FIG. 1. Each player makes a bet in the properly designated betting location 12 in front of each player on the gaming table layout 10 used to play the game. In the preferred embodiment of the present invention, each player's betting location 12 is formatted as a directional compass with the points North, East, South and West represented by their initial letter.

The dealer counts the bets and, if a progressive jackpot is being used as part of the method of play, the dealer registers the total amount wagered on that round of play on a keyboard device (not shown) which causes a portion of the total amount wagered (e.g. one dollar per player or a pre-established percentage) to be registered on a progressive meter (not shown) from which the progressive jackpots are paid. The dealer makes all monetary transactions using the chips contained in the chip rack 18, as is conventional.

Figure 2:
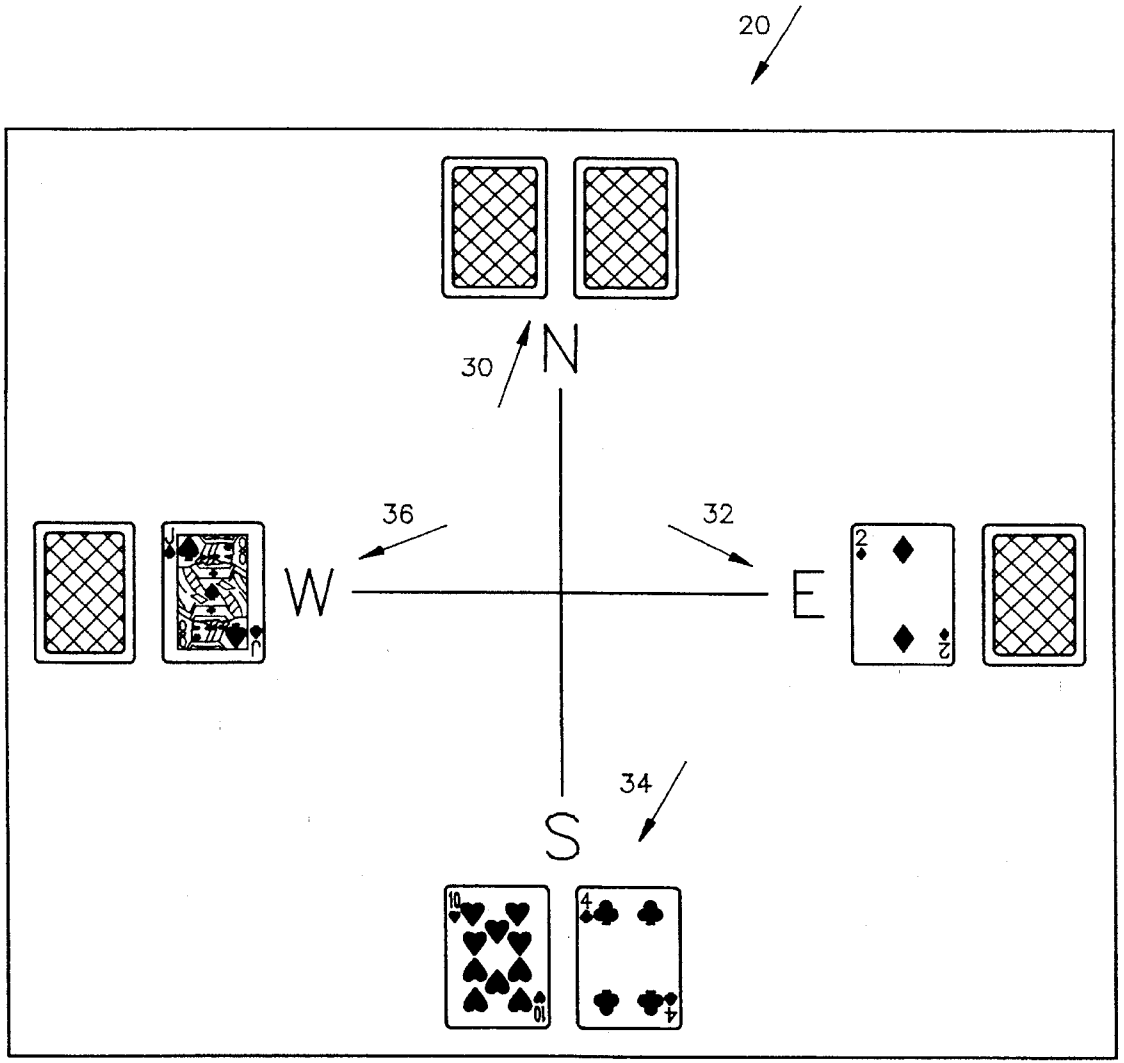
FIG. 2 shows an enlarged representation of one of the community card layouts used in the method of the present.

After the cards have been shuffled and cut according to established casino procedures, the dealer deals three cards to each player. The dealer then deals eight cards as the community cards 20. As shown in FIG. 2, the community cards are arranged in a directional compass with a pair of cards positioned at each point of the compass. At the North point 30, the two cards are dealt face down. At the East point 32, the one card is dealt face down and one card is dealt face up. At the South point 34, the two cards are dealt face up. At the West point 36, the one card is dealt face down and one card is dealt face up.

Each player examines his cards and decides which of the four two-card groups of community cards would best improve the player's hand. The player indicates his selection of one of the two-card groups by moving his betting token to the compass point on his betting location 12 that corresponds to the two card group that the player wishes to use.

The dealer then turns over the remaining community cards that are face down. The dealer determine whether each player has achieved a winning hand by combining the player's three cards with the two card community group that the player has selected.

If a player has a winning hand as determined by the pay table, the player is paid off by the dealer according to the pay table based on the odds set out in the pay table times the amount of the player's wager. If a player does not have a winning hand, his bet is collected by the dealer on behalf of the gaming establishment. The following table shows a preferred pay table to be used with the method of the present invention.

TABLE 1

| POKER HAND | PAYOUT ODDS |
|---|---|
| ROYAL FLUSH | 200 to 1 |
| STRAIGHT FLUSH | 40 to 1 |
| FOUR-OF-A-KIND | 25 to 1 |
| FULL HOUSE | 6 to 1 |
| FLUSH | 5 to 1 |
| STRAIGHT | 4 to 1 |
| THREE-OF-A-KIND | 3 to 1 |
| TWO PAIR | 2 to 1 |
| JACKS OF BETTER | 1 for 1 |

After all bets have been reconciled, if the optional progressive jackpot feature is being used with the method of play, the dealer examines the eight community cards to see if a progressive jackpot bonus payout has occurred. Progressive jackpot bonus payouts occur whenever certain specific predetermined card arrangements appear in the community cards. For example, all of the progressive jackpot could be distributed to the players at the table if all of the community cards are the same color.

In the preferred embodiment of the present invention, the progressive jackpot meter is arranged so that two progressive jackpot amounts are shown. The money that is applied to the progressive jackpot meter is allocated in any desired fashion between the two progressive jackpot amounts. The following predetermined card arrangements are used to determine payouts from the progressive jackpot: All Face Cards wins 100% of the first progressive jackpot amount; and All Cards of the Same Suit wins 100% of the second progressive jackpot amount. Alternatively, a preestablished amount of the first progressive jackpot could be paid if the community cards are all red cards and a preestablished amount of the second progressive jackpot could be paid if the community cards are all black cards. Any winning payouts from the progressive bonus jackpot are distributed to the players at the table, preferably in a pro rata distribution based on the amount of their individual wagers.

After having determined whether a progressive bonus jackpot win has occurred, the dealer collects the remaining cards, shuffles and play begins again.

Alternatively, different card arrangements can be used to determine winning hands for the progressive jackpot. Instead of having two progressive jackpot amounts, all money allocated to the progressive jackpot can be included as one large amount and various portions of the total amount can be paid out for different winning card arrangements.

There are a number of other alternative variations that can be used in the method of play of the present invention.

Figure 3:
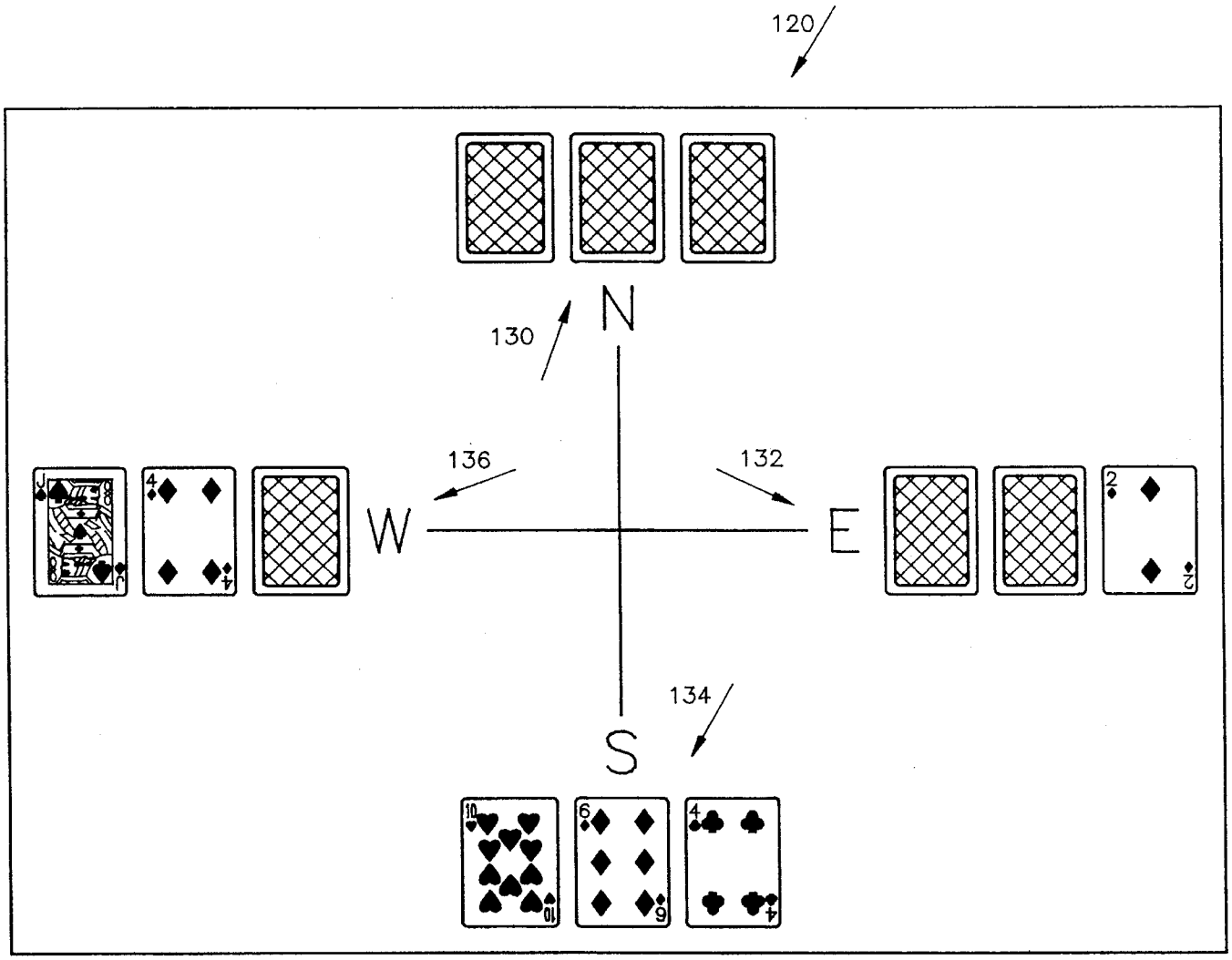
FIG. 3 shows an enlarged representation of another community card layout used in the method of the present.

As shown in FIG. 3, three cards are dealt to each point of the compass. To begin each round of the game, the cards are shuffled and cut according to established casino procedures. The dealer deals two cards to each player. The dealer then deals twelve cards as the community cards 120. At the North point 130, the three cards are dealt face down. At the East point 132, two cards are dealt face down and one card is dealt face up. At the South point 134, the three cards are dealt face up. At the West point 136, one card is dealt face down and two cards are dealt face up.

Each player examines his cards and decides which of the four three-card groups of community cards would best improve the player's hand. The player indicates his selection of one of the two-card groups by moving his betting token to the compass point on his betting location that corresponds to the three card group that the player wishes to use.

The dealer then turns over the remaining community cards that are face down. The dealer determine whether each player has a winning hand.

If a player has a winning hand as determined by the pay table, the player is paid off by the dealer according to the pay table based on the odds set out in the pay table times the amount of the player's wager. If a player does not have a winning hand, his bet is collected by the dealer on behalf of the gaming establishment.

Figure 4:
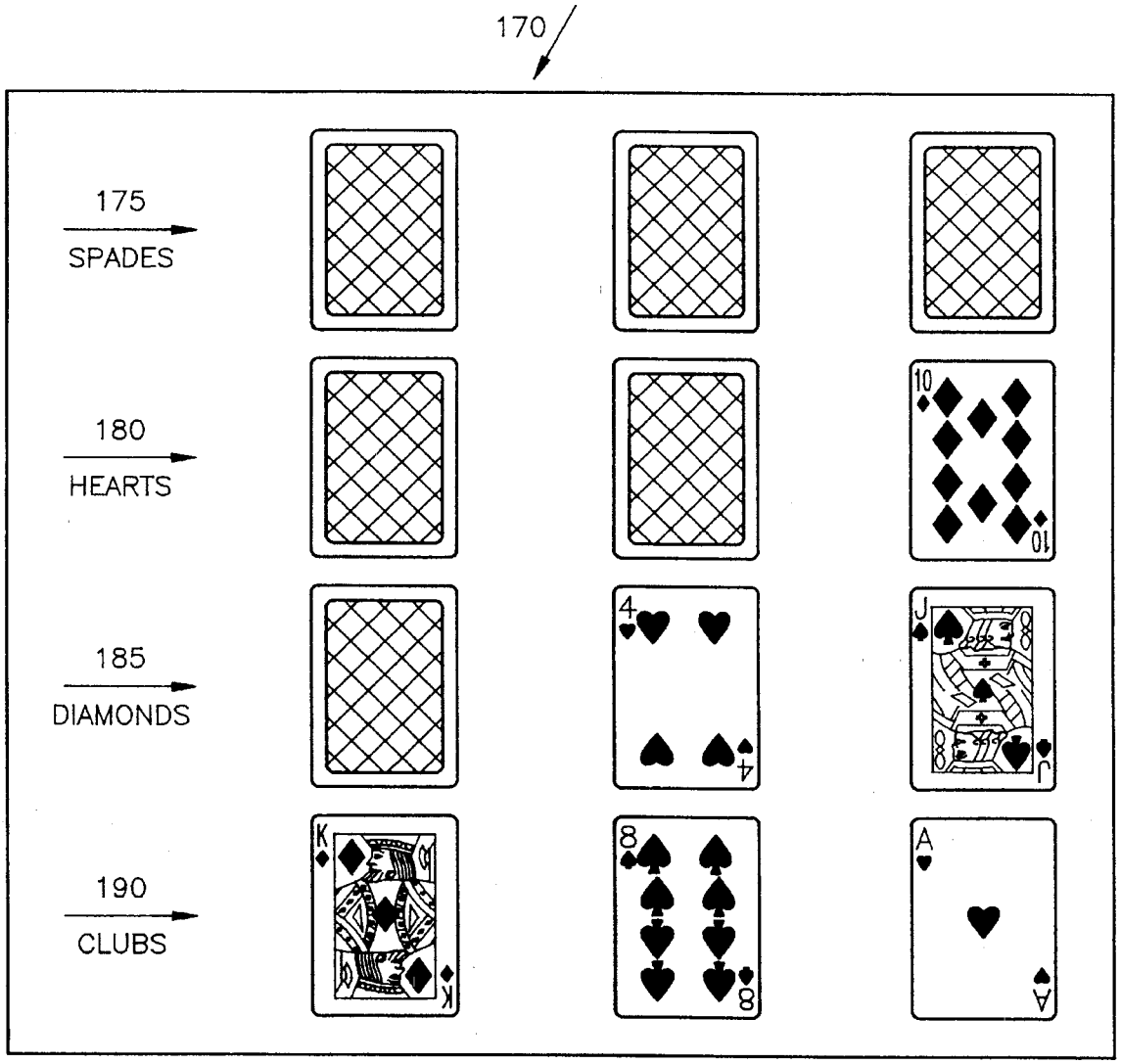
FIG. 4 shows an enlarged representation of another community card layout used in another variation of the method of the present.

Any other suitable layout of the community cards can be used as long as the method of play specifies groups of cards from which each player selects cards to be used to comprise the player's hand. For example, instead of using a directional compass, the community card layout could use the four card suits (Spades, Hearts, Diamonds and Clubs) as the four designators for the groups. For example, FIG. 4 shows a group 170 of community cards in which the first row is designated as the Spades row 175 and contains three cards, all face down. The second row is designated as the Hearts row 180 and contains one card face up and two cards face down. The third row is designated as the Diamonds row 185 and contains one card face down and two cards face up. The fourth row is designated as the Clubs row 190 and contains three cards, all face up.

The cards could be arranged in a diamond, in a square, in a rectangular, in any suitable geometric shape or even haphazardly on the table layout as long as the players know which community cards are associated with which card group.

In another variation, the dealer can also receive a five card hand dealt to himself. In order to have a winning hand, the player must beat the dealer's hand. The payout table is adjusted accordingly.

Figure 5:
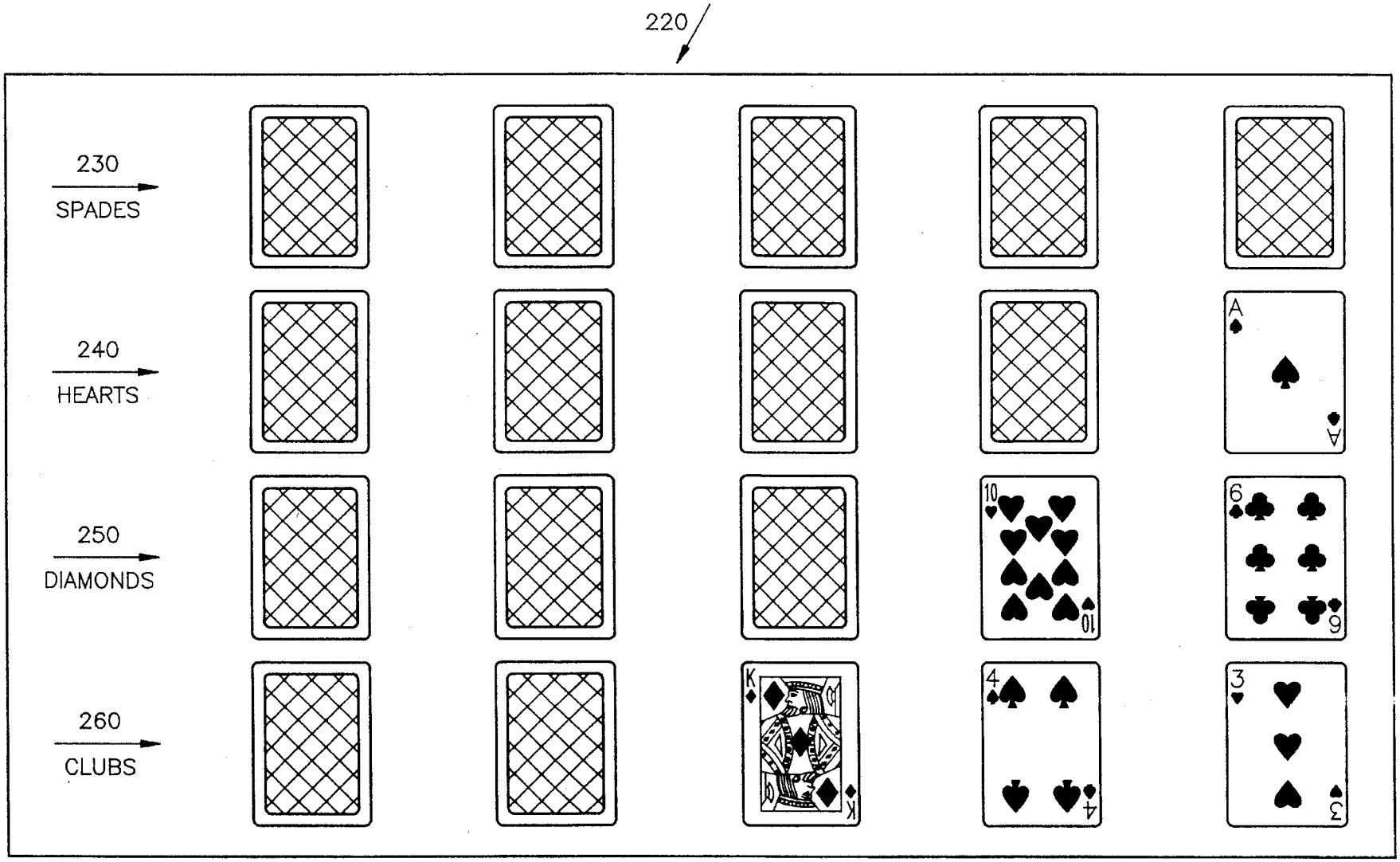
FIG. 5 shows an enlarged representation of another community card layout used in another Variation of the method of the present.

FIG. 5 shows another variation of the present invention. In this variation, no cards are dealt to the players, but rather four groups of five cards hands are arranged on the gaming table layout in any appropriate configuration 220. In the preferred embodiment shown in FIG. 5, the four groups of five cards are arranged in rows across the gaming table layout. Any suitable demarkers can be used to identify each row, e.g. row 230 is identified as the "Spades" row, row 240 is identified as the "Hearts" row, row 250 is identified as the "Diamonds" row and row 260 is identified as the "Clubs" row. In one row, all of the cards are dealt face down. In another row, four cards are face down and the remaining card is face up. In another row, three cards are face down and the remaining two cards are face up. In the last row, two cards are face down and the remaining three cards are face up.

Each player selects which of the four five-card groups he wishes to use as his hand and moves his wager to the correspondingly demarked position on his betting location. The dealer turns up all of the remaining cards which are face down and determines whether each player has a winning hand. If a player has a winning hand as determined by the pay table, the player is paid off by the dealer according to the pay table based on the odds set out in the pay table times the amount of the player's wager. If a player does not have a winning hand, his bet is collected by the dealer on behalf of the gaming establishment.

Figure 6:
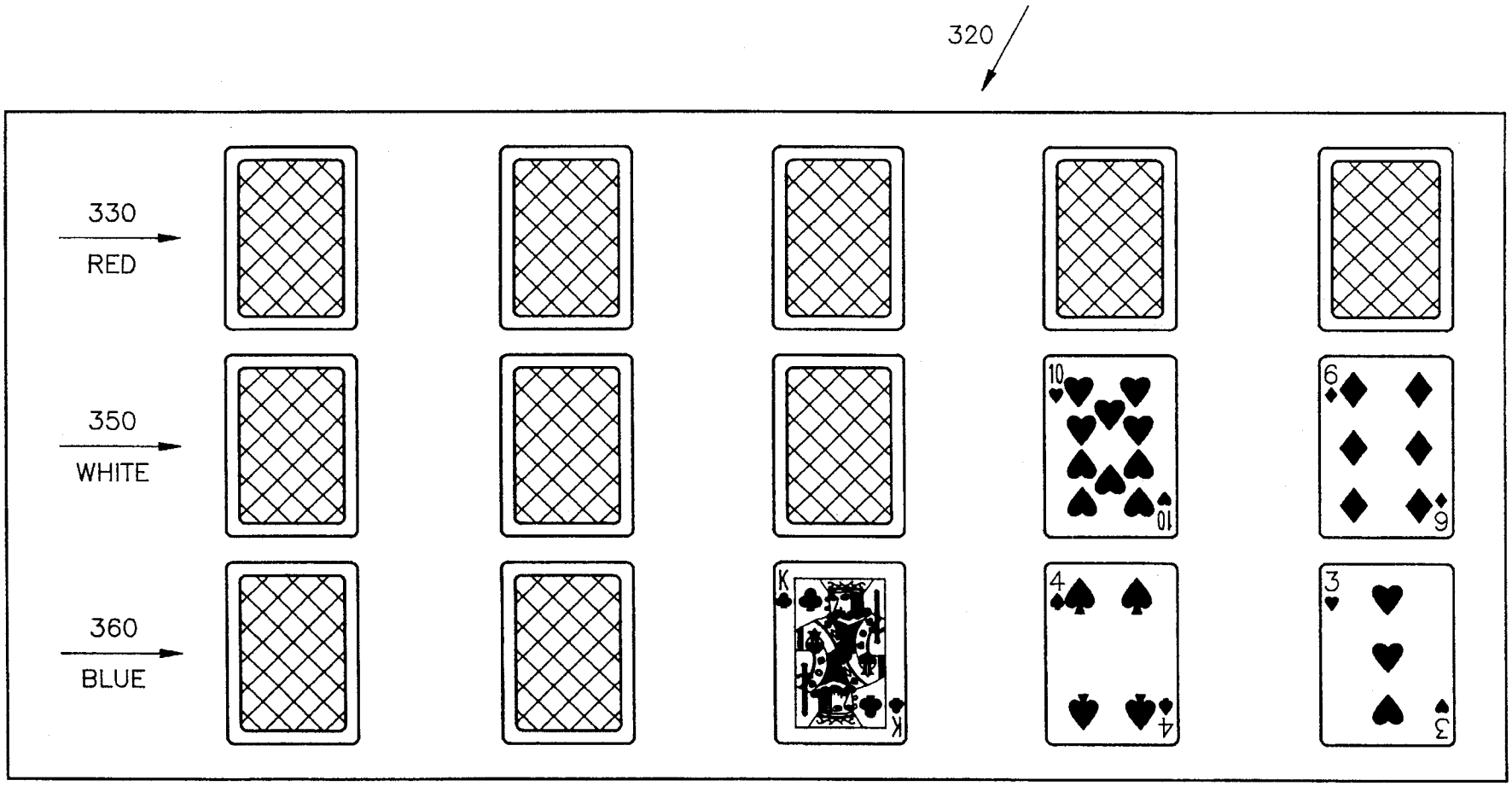
FIG. 6 shows an enlarged representation of another card layout used in yet another variation of the method of the present.

FIG. 6 shows another variation of the present invention similar to that shown in FIG. 5. In this variation only three groups of five cards are used. In the preferred embodiment of this variation as shown in FIG. 5, the three groups 320 of five cards are arranged in rows across the gaming table layout. Any suitable demarkers can be used to identify each row, e.g. row 330 is identified as the "Red" row, row 350 is identified as the "White" row and row 360 is identified as the "Blue" row. In one row, all of the cards are dealt face down. In another row, three cards are face down and the remaining two cards are face up. In the last row, two cards are face down and the remaining three cards are face up.

Each player selects which of the three five-card groups he wishes to use as his hand and moves his wager to the correspondingly demarked position on his betting location. The dealer turns up all of the remaining cards which are face down and determines whether each player has a winning hand. If a player has a winning hand as determined by the pay table, the player is paid off by the dealer according to the pay table based on the odds set out in the pay table times the amount: of the player's wager. If a player does not have a winning hand, his bet is collected by the dealer on behalf of the gaming establishment. In this variation, the odds in the pay table are adjusted to reflect the fact that odds of making different types of poker hands would be different than the odds related to the variation described above in reference to FIG. 5.

Figure 7:
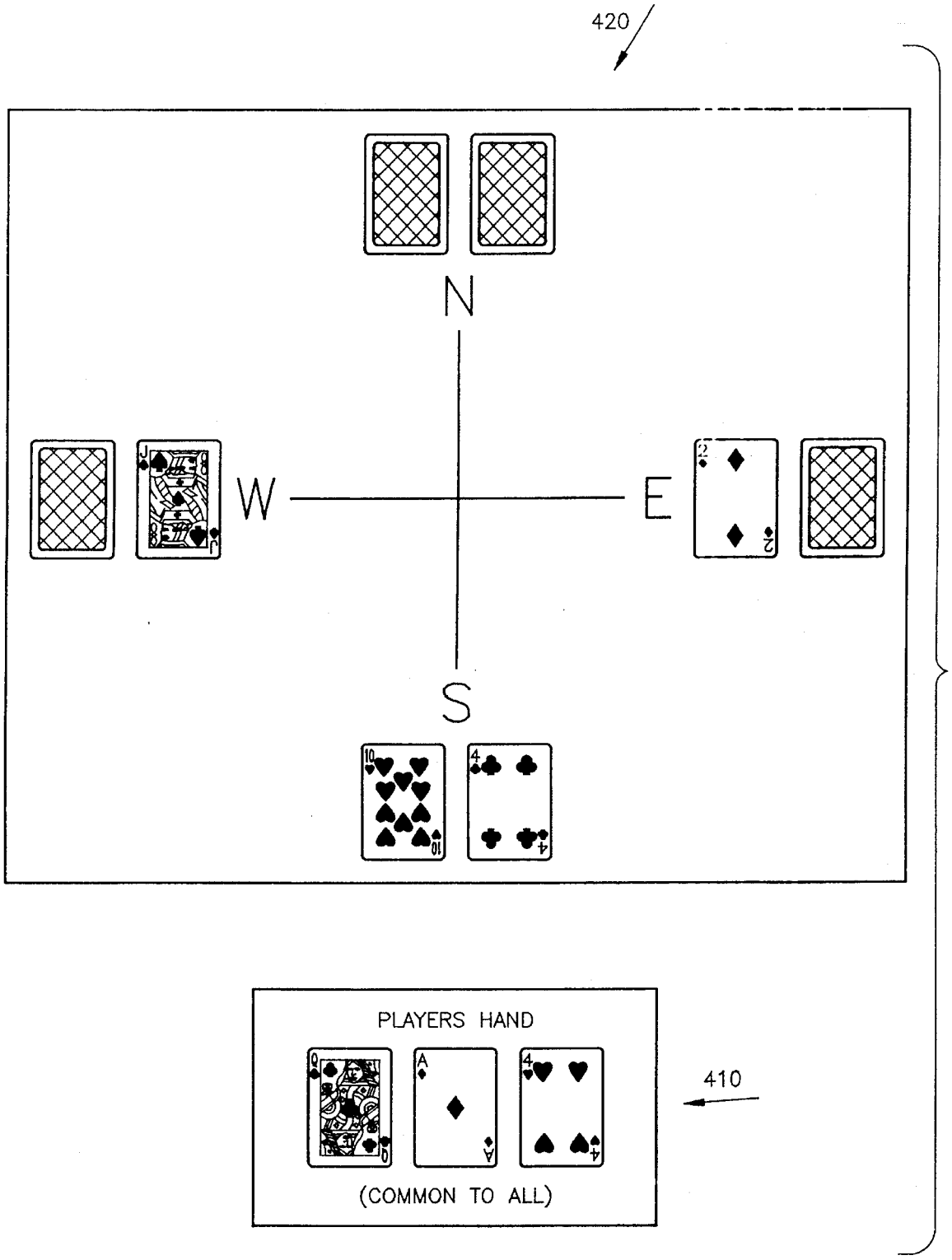
FIG. 7 shows an enlarged representation of another community card layout used in another Variation of the method of the present in which only one player's hand is used.

Another variation is shown in FIG. 7. Instead of dealing three cards separately to each player, the three player cards are dealt as community cards and arranged at a suitable location 410 on the gaming table layout. These first three cards are common cards used by all players at the gaming table. Each player decides which of the four two-card groups 420 when combined with the three community cards will make the best poker hand and the player moves his wager to the correspondingly marked position on his betting location. The dealer turns up all of the remaining cards which are face down and determines whether each player has a winning hand. If a player has a winning hand as determined by the pay table, the player is paid off by the dealer according to the pay table based on the odds set out in the pay table times the amount of the player's wager. If a player does not have a winning hand, his bet is collected by the dealer on behalf of the gaming establishment.

Figure 8:
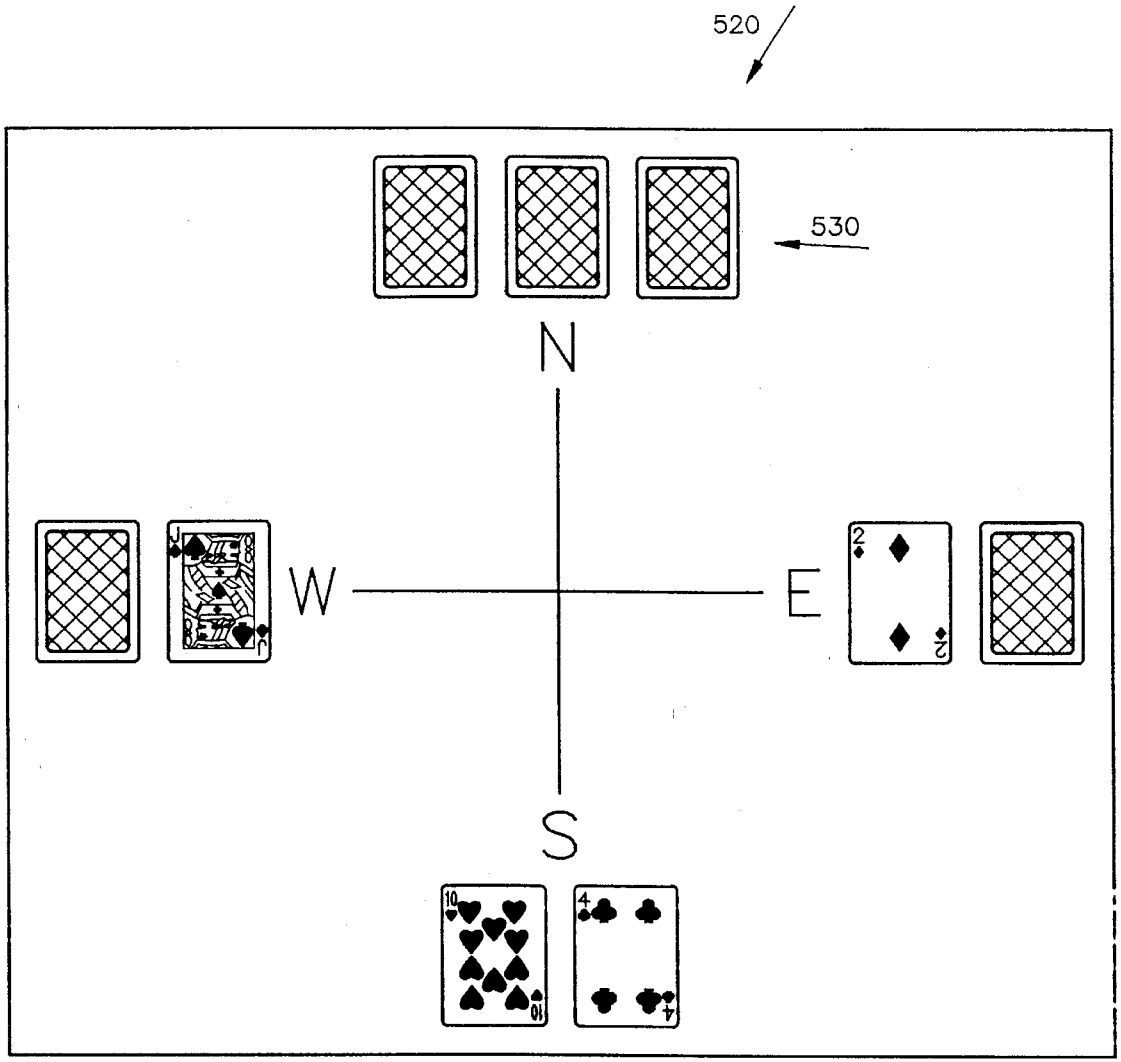
FIG. 8 shows an enlarged representation of another community card layout used in another Variation of the method of the present.

FIG. 8 shows yet another version of the present invention. This variation is the same as that shown in FIG. 2, except that the group 520 of community cards uses three down cards 530 at the North position. Each player receives three cards. If a player wishes to use the North position cards 530, that player must discard one of his three original cards. Otherwise, the game proceeds in the same manner as that described in connection with the method of play shown in FIG. 2.

Figure 9:
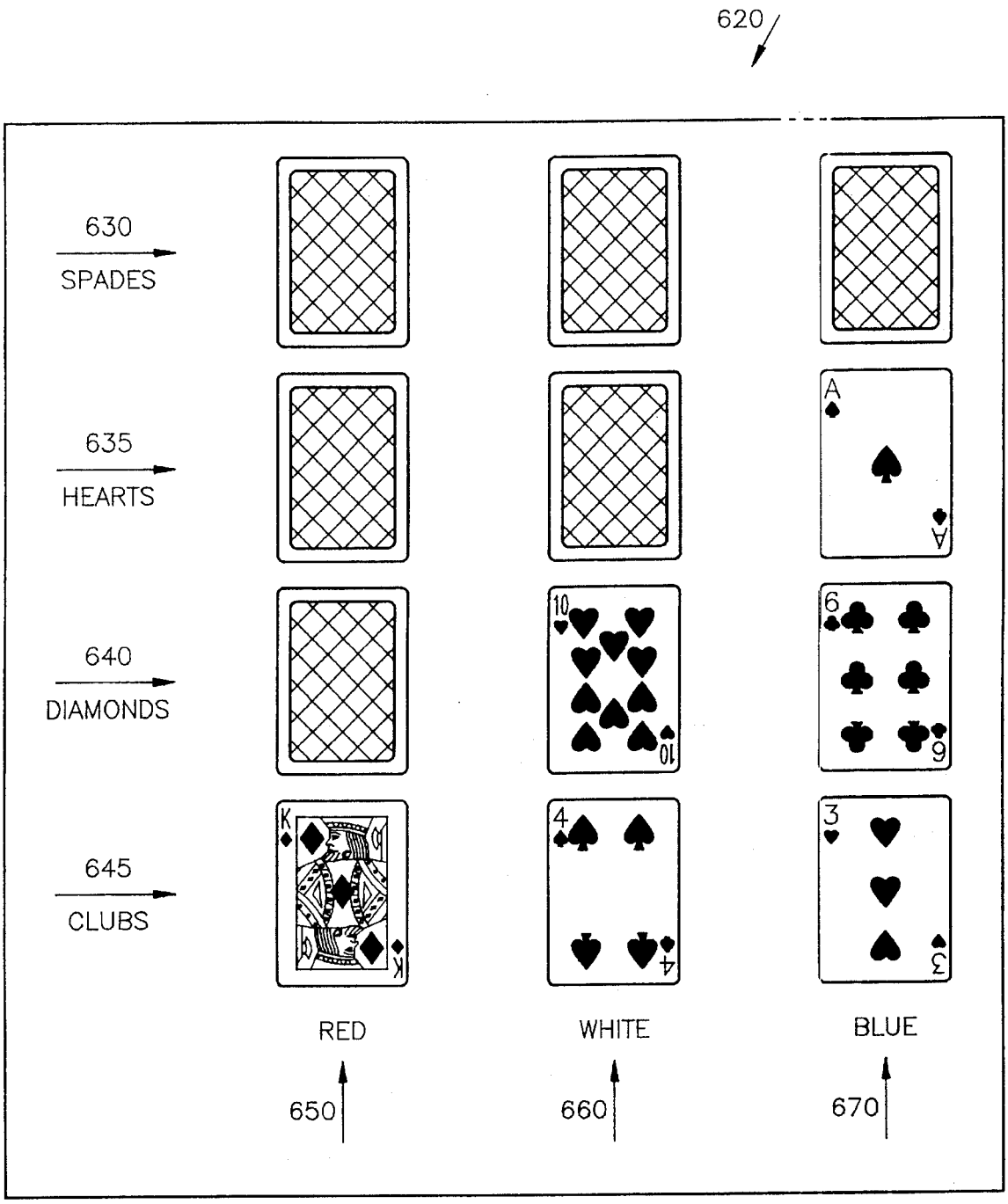
FIG. 9 shows an enlarged representation of another community card layout used in another variation of the method of the present.

FIG. 9 shows another variation of the method of the present invention in which the community card layouts can be utilized either horizontally or vertically. In this version, the community card group 620 comprises a matrix of three columns and four rows. With reference to FIG. 9, the top row 630 is denominated as the Spades row and has three cards, all face down. The second row 635 is designated as the Hearts row and contains two cards face down and one card face up. The third row 640 is designated as the Diamonds row and contains one card face down and two cards face up. The fourth row 645 is designated as the Clubs row and contains three cards, all face up.

Likewise, the left column 650 is designated as the Red column and contains three cards face own and one card face up. The middle column 660 is designated as the White column and contains two cards face down and two cards face up. The right column 670 is designated as the Blue column and contains one card face down and three cards face up.

Each player is dealt two cards. If a player wishes to use both of the cards in his hand, the player chooses one of the three card rows to comprise his hand. Alternatively, a player may discard one of his two original cards and choose one of the four card columns to comprise his hand. The player indicates his selection of one of the these choices by moving his wager to the appropriate marking one his betting location that corresponds to the three card row or the four card column that the player wishes to use.

The dealer then turns over the remaining community cards that are face down. The dealer determine whether each player has a winning hand.

If a player has a winning hand as determined by the pay table, the player is paid off by the dealer according to the pay table based on the odds set out in the pay table times the amount of the player's wager. If a player does not have a winning hand, his bet is collected by the dealer on behalf of the gaming establishment.

Figure 10:
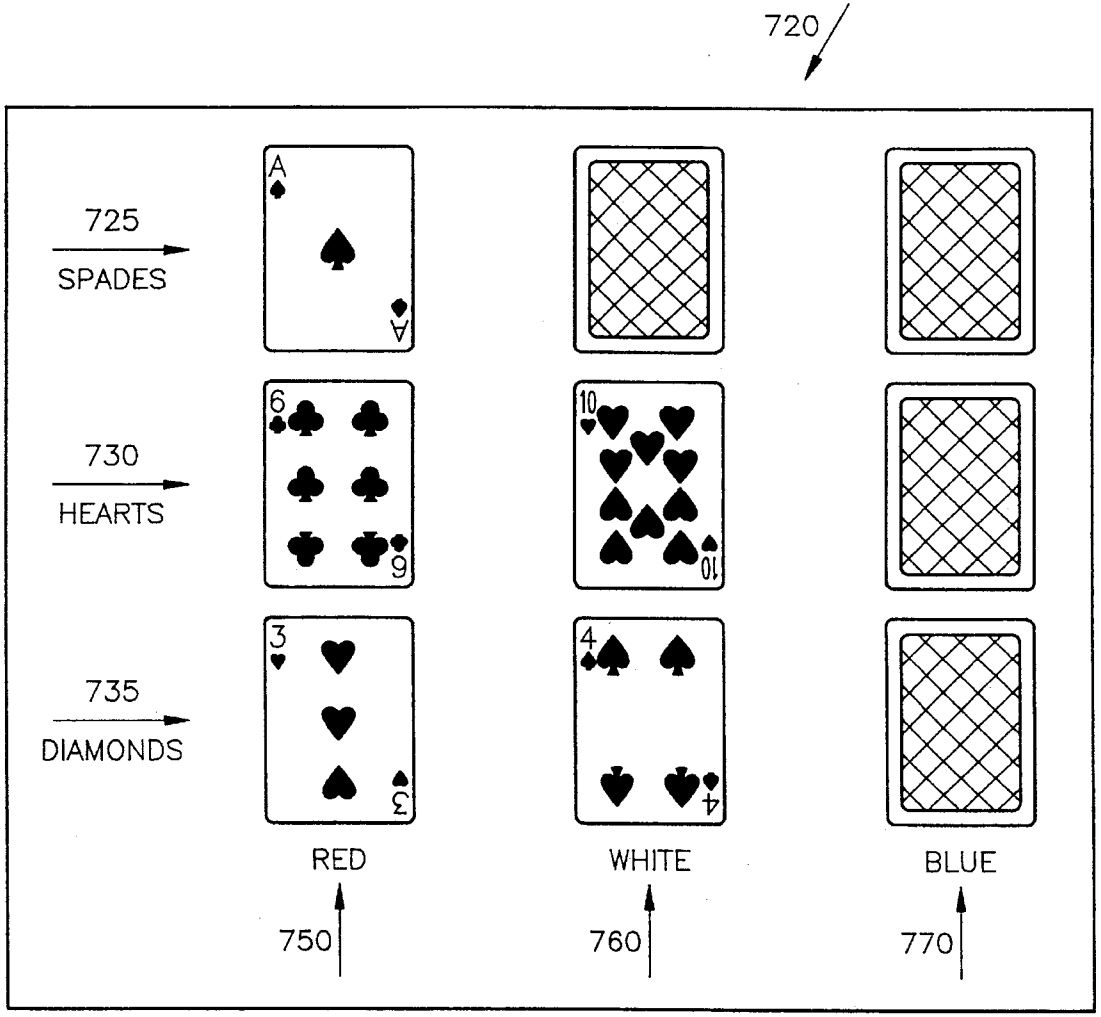
FIG. 10 shows an enlarged representation of another community card layout used in another variation of the method of the present.

FIG. 10 shows another variation similar to FIG. 9. In this version, the community card group 720 comprises a matrix of three columns and three rows. With reference to FIG. 10, the top row 725 is denominated as the Spades row and contains one card face up and two cards face down. The second row 730 is designated as the Hearts row and contains two cards face up and one card face down. The third row 735 is designated as the Diamonds row and contains two cards face and one card face up.

Likewise, the left column 750 is designated as the Red column and contains three cards face up. The middle column 760 is designated as the White column and contains two cards face up and one card face down. The right column 770 is designated as the Blue column and contains three cards face down.

Each player is dealt two cards and the player chooses one of the three card rows or three card columns to comprise his hand. The player indicates his selection of one of the these choices by moving his wager to the appropriate marking on his betting location that corresponds to thee three card row or the four card column that the player wishes to use.

The dealer then turns over the remaining community cards that are face down. The dealer determine whether each player has a winning hand.

If a player has a winning hand as determined by the pay table, the player is paid off by the dealer according to the pay table based on the odds set out in the pay table times the amount of the player's wager. If a player does not have a winning hand, his bet is collected by the dealer on behalf of the gaming establishment.

The progressive jackpot feature described above can also be applied to any of these variations of the present invention. For example, in those variations that use a large number of community cards, a winning progressive jackpot combination could be all of the community cards being face cards or all twelve face cards being among the community cards. Alternatively, a winning progressive jackpot combination could be the community cards being all face cards and Aces.

The method of the present invention may also be played as a player banked game in which one of the players takes the place of the house and assumes the responsibility for paying winning hands and collecting losing wagers. Each player (except the player banking the game) makes a bet in the properly designated space. The game is dealt according to any of the variations described above. After the play of the hand is completed, the dealer determines which players have winning hands and the player banking the game pays the winning players according to the payout schedule in the same manner that the house would pay winning players in the house banked version of the present invention. The player banking the game also collects all losing wagers.

The same variations as discussed above relative to the house banked version of the game may also be applied to the player banked version of the game. The optional progressive jackpot feature may also be used.

The method of the present invention can also be adapted to a video gaming device in much the same manner as Draw Poker has been adapted to a video gaming device. The electronic gaming machine is provided with a video monitor that displays both the community card groups and the player's hand. The player inserts a coin or token to activate the electronic gaming machine and presses the deal button to display the cards. By pressing various buttons that are provided on the gaming machine, the player determines which of the community card groups to use to comprise the player's hand. After the player completes the selection, the gaming machine reveals the face down cards, displays the results of the play and awards the player any winning amounts to which the player may be entitled. The method of the present invention is intended to cover both the live gaming table version of the game as well as an electronic video gaming machine version of the game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker-style game using a standard deck of playing cards comprising:

a) dealing an initial hand of three cards to a player;

b) arranging a collection of community cards comprising eight cards from the deck in a predetermined pattern of distinct groups of two cards each in which a first group has two cards face down, a second group has one card face up and one card face down, a third group has one card face up and one card face down and a fourth group which has two cards face up;

c) the player selecting, prior to exposing any face down cards, one of the first group, the second group, the third group or the fourth group to comprise the player's hand;

d) exposing all of the cards which were face down; and e) examining the player's completed hand to determine a poker hand ranking thereof.

2. The method of claim 1 in which the community cards are arranged as the points of a compass and the first group is the North compass point, the second group is the East compass point, the third group is the West compass point and the fourth group is the South compass point.

3. A method of playing a poker-style game using a standard deck of playing cards comprising:

a) a player making a wager to participate in the game;

b) dealing an initial hand of three cards to a player;

c) arranging a collection of community cards comprising eight cards from the deck in a predetermined pattern of distinct groups of two cards each in which a first group has two cards face up, a second group has one card face up and one card face down, a third group has one card face up and one card face down and a fourth group which has two cards face up;

d) the player selecting, prior to exposing any face down cards, one of the first group, the second group, the third group or the fourth group to comprise the player's hand;

e) exposing all of the cards which were face down;

f) examining the player's completed hand to determine a poker hand ranking thereof; and g) paying the player a preestablished amount based on the poker hand ranking achieved by the player's completed hand.

4. The method of claim 3 in which the community cards are arranged as the points of a compass and the first group is the North compass point, the second group is the East compass point, the third group is the West Compass point and the fourth group is the South compass point.

5. The method of claim 3 in which the pre-established amount to be paid to the player is based on a payout table.

6. The method of claim 3 in which the payout table comprises:

| POKER HAND | PAYOUT ODDS |
|---|---|
| ROYAL FLUSH | 250 to 1 |
| STRAIGHT FLUSH | 40 to 1 |
| FOUR-OF-A-KIND | 25 to 1 |
| FULL HOUSE | 6 to 1 |
| FLUSH | 5 to 1 |
| STRAIGHT | 4 to 1 |
| THREE-OF-A-KIND | 3 to 1 |
| TWO PAIR | 2 to 1 |
| JACKS OF BETTER | 1 for 1 |

7. The method of claim 3 further comprising:

a) allocating a portion of the wager to a progressive jackpot; and b) paying the player a preestablished amount of the progressive jackpot if the community cards form a predetermined arrangement of cards.

8. The method of claim 7 in which the player is paid all of the progressive jackpot if the community cards are all cards of the same suit.

9. The method of claim 7 in which the player is paid a portion of the progressive jackpot if the community cards are all face cards.

10. The method of claim 3 further comprising:

a) allocating a portion of the wager to a first progressive jackpot and a second progressive jackpot;

b) paying the player a preestablished amount of the first progressive jackpot if the community cards are all face cards; and c) paying the player a preestablished amount of the second progressive jackpot if the community cards are all cards of the same suit.

11. A method of playing a poker-style game using a standard deck of playing cards comprising:

a) dealing an initial hand of two cards to a player;

b) arranging a collection of community cards comprising twelve cards from the deck in a predetermined pattern of distinct groups of three cards each in which a first group has three cards face down, a second group has one card face up and two cards face down, a third group has two cards face up and one card face down and a fourth group which has three cards face up;

c) the player selecting, prior to exposing any face down cards, one of the first group, the second group, the third group or the fourth group to comprise the player's hand;

d) exposing all of the cards which were face down; and e) examining the player's completed hand to determine a poker hand ranking thereof.

12. The method of claim 11 in which the community cards are arranged as the points of a compass and the first group is the North compass point, the second group is the East compass point, the third group is the West compass point and the fourth group is the South compass point.

13. The method of claim 11 in which the community cards are arranged as a three-by-four matrix and the first group is the first row of the matrix, the second group is the second row of the matrix, the third group is the third row of the matrix and the fourth group is the fourth row of the matrix.

14. A method of playing a poker-style game using a standard deck of playing cards comprising:

a) a player making a wager to participate in the game;

b) dealing an initial hand of two cards to a player;

c) arranging a collection of community cards comprising twelve cards from the deck in a predetermined pattern of distinct groups of three cards each in which a first group has three cards face down, a second group has one card face up and two cards face down, a third group has two cards face up and one card face down and a fourth group which has three cards face up;

d) the player selecting, prior to exposing any face down cards, one of the first group, the second group, the third group or the fourth group to comprise the player's hand;

e) exposing all of the cards which were face down;

f) examining the player's completed hand to determine a poker hand ranking thereof; and g) paying the player a preestablished amount based on the poker hand ranking achieved by the player's completed hand.

15. The method of claim 14 in which the community cards are arranged as the points of a compass and the first group is the North compass point, the second group is the East compass point, the third group is the West compass point and the fourth group is the South compass point.

16. The method of claim 14 in which the community cards are arranged as a three-by-four matrix and the first group is the first row of the matrix, the second group is the second row of the matrix, the third group is the third row of the matrix and the fourth group is the fourth row of the matrix.

17. The method of claim 14 in which the pre-established amount to be paid to the player is based on a payout table.

18. The method of claim 17 in which the payout table comprises:

| POKER HAND | PAYOUT ODDS |
|---|---|
| ROYAL FLUSH | 250 to 1 |
| STRAIGHT FLUSH | 40 to 1 |
| FOUR-OF-A-KIND | 25 to 1 |
| FULL HOUSE | 6 to 1 |
| FLUSH | 5 to 1 |
| STRAIGHT | 4 to 1 |
| THREE-OF-A-KIND | 3 to 1 |
| TWO PAIR | 2 to 1 |
| JACKS OF BETTER | 1 for 1 |

19. The method of claim 14 further comprising:

a) allocating a portion of the wager to a progressive jackpot; and b) paying the player a preestablished amount of the progressive jackpot if the community cards form a predetermined arrangement of cards.

20. The method of claim 19 in which the player is paid all of the progressive jackpot if the community cards are all cards of the same suit.

21. The method of claim 19 in which the player is paid a portion of the progressive jackpot if the community cards are all face cards.

22. The method of claim 14 further comprising:

a) allocating a portion of the wager to a first progressive jackpot and a second progressive jackpot;

b) paying the player a preestablished amount of the first progressive jackpot if the community cards are all face cards; and c) paying the player a preestablished amount of the second progressive jackpot if the community cards are all cards of the same suit.

23. A method of playing a poker-style game using a standard deck of playing cards comprising:

a) arranging a collection of community cards comprising twenty cards from the deck in a predetermined pattern of distinct groups of five cards each in which a first group has five cards face down, a second group has one card face up and four cards face down, a third group has two cards face up and three cards face down and a fourth group which has three cards face up and two cards face down;

b) the player selecting, prior to exposing any face down cards, one of the first group, the second group, the third group or the fourth group to comprise the player's hand;

c) exposing all of the cards which were face down; and d) examining the player's completed hand to determine a poker hand ranking thereof.

24. A method of playing a poker-style game using a standard deck of playing cards comprising:

a) a player making a wager to participate in the game;

b) arranging a collection of community cards comprising twenty cards from the deck in a predetermined pattern of distinct groups of five cards each in which a first group has five cards face down, a second group has one card face up and four cards face down, a third group has two cards face up and three cards face down and a fourth group which has three cards face up and two cards face down;

c) the player selecting, prior to exposing any face down cards, one of the first group, the second group, the third group or the fourth group to the player's hand;

d) exposing all of the cards which were face down; and e) examining the player's completed hand to determine a poker hand ranking thereof; and f) paying the player a preestablished amount based on the poker hand ranking achieved by the player's completed hand.

25. A method of playing a poker-style game using a standard deck of playing cards comprising:

a) arranging a collection of community cards comprising fifteen cards from the deck in a predetermined pattern of distinct groups of five cards each in which a first group has five cards face down, a second group has two cards face up and three cards face down and a third group which has three cards face up and two cards face down;

b) the player selecting, prior to exposing any face down cards, one of the first group, the second group or the third group to comprise the player's hand;

c) exposing all of the cards which were face down; and d) examining the player's selected hand to determine a poker hand ranking thereof.

26. A method of playing a poker-style game using a standard deck of playing cards comprising:

a) a player making a wager to participate in the game;

b) arranging a collection of community cards comprising fifteen cards from the deck in a predetermined pattern of distinct groups of five cards each in which a first group has five cards face down, a second group has two cards face up and three cards face down and a third group which has three cards face up and two cards face down;

c) the player selecting, prior to exposing any face down cards, one of the first group, the second group or the third group to comprise the player's hand;

d) exposing all of the cards which were face down; and e) examining the player's completed hand to determine a poker hand ranking thereof; and f) paying the player a preestablished amount based on the poker hand ranking achieved by the player's completed hand.

27. A method of playing a poker-style game using a standard deck of playing cards comprising:

a) dealing an initial hand of three cards to a player;

b) arranging a collection of community cards comprising nine cards from the deck in a predetermined pattern of one three card group and three two card groups in which a first group has three cards face down, a second group has one card face up and one card face down, a third group has one card face up and one card face down and a fourth group has two cards face up;

c) the player selecting, prior to exposing any face down cards, one of the first group, the second group, the third group or the fourth group to comprise the player's hand;

d) if the player selects the first group, the player discarding one of his initial cards;

e) exposing all of the cards which were face down; and f) examining the player's completed hand to determine a poker hand ranking thereof.

28. A method of playing a poker-style game using a standard deck of playing cards comprising:

a) a player making a wager to participate in the game;

b) dealing an initial hand of three cards to a player;

c) arranging a collection of community cards comprising nine cards from the deck in a predetermined pattern of one three card group and three two card groups in which a first group has three cards face down, a second group has one card face up and one card face down, a third group has one card face up and one card face down and a fourth group has two cards face up;

d) the player selecting, prior to exposing any face down cards, one of the first group, the second group, the third group or the fourth group to comprise the player's hand;

e) if the player selects the first group, the player discarding one of his initial cards;

f) exposing all of the cards which were face down;

g) examining the player's completed hand to determine a poker hand ranking thereof; and h) paying the player a preestablished amount based on the poker hand ranking achieved by the player's completed hand.

29. A method of playing a poker-style game using a standard deck of playing cards comprising:

a) dealing an initial hand of two cards to a player;

b) arranging a collection of community cards comprising twelve cards from the deck in a three-by-four matrix of card groups in which a first row has three cards face down, a second row has one card face up and two cards face down, a third row has two cards face up and one card face down and a fourth row which has three cards face up; and a first column has one card face up and three card face down, a second column has two cards face up and two cards face down and a third column has three cards face up and one card face down;

c) if the player decides not to discard any of his original two cards, the player selecting, prior to exposing any face down cards, one of the first row, the second row, the third row or the fourth row to comprise the player's hand;

d) if the player decides to discard one of his original two cards, the player selecting, prior to exposing any face down cards, one of the first column, the second column or the third column to comprise the player's hand;

e) exposing all of the cards which were face down; and f) examining the player's completed hand to determine a poker hand ranking thereof.

30. A method of playing a poker-style game using a standard deck of playing cards comprising:

a) a player making a wager to participate in the game;

b) dealing an initial hand of three cards to a player;

c) arranging a collection of community cards comprising twelve cards from the deck in a three-by-four matrix of card groups in which a first row has three cards face down, a second row has one card face up and two cards face down, a third row has two cards face up and one card face down and a fourth row which has three cards face up; and a first column has one card face up and three cards face down, a second column has two cards face up and two cards face down and a third column has three cards face up and one card face down;

d) if the player decides not to discard any of his original two cards, the player selecting, prior to exposing any face down cards, one of the first row, the second row, the third row or the fourth row to comprise the player's hand;

e) if the player decides to discard one of his original two cards, the player selecting, prior to exposing any face down cards, one of the first column, the second column and the third column to comprise the player's hand;

f) exposing all of the cards which were face down;

g) examining the player's completed hand to determine a poker hand ranking thereof; and h) paying the player a preestablished amount based on the poker hand ranking achieved by the player's completed hand.

31. A method of playing a poker-style game using a standard deck of playing cards comprising:

a) dealing an initial hand of two cards to a player;

b) arranging a collection of community cards comprising nine cards from the deck in a three-by-three matrix of three card groups in which a first row has one card face up and two cards face down, a second row has two cards face up and one card face down and a third row which has two cards face up and one card face down; and a first column has three cards face up, a second column has two cards face up and one card face down and a third column has three cards face down;

c) the player selecting, prior to exposing any face down cards, one of the first row, the second row, the third row, the first column, the second column or the third column to comprise the player's hand;

d) exposing all of the cards which were face down; and e) examining the player's completed hand to determine a poker hand ranking thereof.

32. A method of playing a poker-style game using a standard deck of playing cards comprising:

a) a player making a wager to participate in the game;

b) dealing an initial hand of two cards to a player;

c) arranging a collection of community cards comprising nine cards from the deck in a three-by-three matrix of three card groups in which a first row has one card face up and two cards face down, a second row has two cards face up and one card face down and a third row which has two cards face up and one card face down; and a first column has three cards face up, a second column has two cards face up and one card face down and a third column has three cards face down;

d) the player selecting, prior to exposing any face down cards, one of the first row, the second row, the third row, the first column, the second column or the third column to comprise the player's hand;

e) exposing all of the cards which were face down;

f) examining the player's completed hand to determine a poker hand ranking thereof; and g) paying the player a preestablished amount based on the poker hand ranking achieved by the player's completed hand.

33. A method of playing a poker-style game using a standard deck of playing cards in which multiple bettors may wager on the outcome of the game comprising:

a) at least one bettor making a wager to participate in the game;

b) dealing an initial hand of three cards designated as a player hand;

c) arranging a collection of community cards comprising eight cards from the deck in a predetermined pattern of distinct groups of two cards each in which a first group has two cards face up, a second group has one card face up and one card face down, a third group has one card face up and one card face down and a fourth group which has two cards face up;

d) the bettor selecting, prior to exposing any face down cards, one of the first group, the second group, the third group or the fourth group to comprise the player's hand to be used by that bettor;

e) exposing all of the cards which were face down;

f) examining the player's completed hand to determine a poker hand ranking thereof; and g) paying the bettor a preestablished amount based on the poker hand ranking achieved by the player's completed hand.

* * * * *